US009926158B2

(12) United States Patent
Brouilette et al.

(10) Patent No.: US 9,926,158 B2
(45) Date of Patent: Mar. 27, 2018

(54) STERILE SAMPLING BAG, ROLL OF BAGS, AND BAG DISPENSER

(71) Applicant: LABPLAS INC., Ste-Julie (CA)

(72) Inventors: Marc Brouilette, Mont-Saint-Hilaire (CA); Danielle Lafond, Mont-Saint-Hilaire (CA); Alain Chevigny, Val-Morin (CA)

(73) Assignee: LABPLAS INC., Ste-Julie (CA)

( * ) Notice: Subject to any disclaimer, the term of this patent is extended or adjusted under 35 U.S.C. 154(b) by 181 days.

(21) Appl. No.: 14/675,398

(22) Filed: Mar. 31, 2015

(65) Prior Publication Data

US 2015/0353312 A1 Dec. 10, 2015

Related U.S. Application Data

(60) Provisional application No. 61/973,143, filed on Mar. 31, 2014.

(51) Int. Cl.

| | |
|---|---|
| ***B65H 16/00*** | (2006.01) |
| ***B65D 5/72*** | (2006.01) |
| ***B65H 16/02*** | (2006.01) |
| ***B65H 18/28*** | (2006.01) |
| ***B65H 35/04*** | (2006.01) |
| ***B65D 5/66*** | (2006.01) |

(Continued)

(52) U.S. Cl.

CPC ..... *B65H 16/005* (2013.01); *B65D 5/18* (2013.01); *B65D 5/6685* (2013.01); *B65D 5/727* (2013.01); *B65D 33/002* (2013.01); *B65D 83/0805* (2013.01); *B65H 16/028* (2013.01); *B65H 18/28* (2013.01); *B65H 35/04* (2013.01); *B65H 2301/4193* (2013.01); *B65H 2301/5152* (2013.01); *B65H 2701/191* (2013.01)

(58) Field of Classification Search

CPC .... B65H 16/005; B65H 16/028; B65H 18/28; B65H 35/04; B65H 2301/4193; B65H 2301/5152; B65D 5/18; B65D 5/6685; B65D 5/727; B65D 33/002; B65D 83/0805

USPC ..... 242/588

See application file for complete search history.

(56) References Cited

U.S. PATENT DOCUMENTS

D192,696 S 5/1962 Saxe
3,098,594 A * 7/1963 Williamson ..... B65D 83/0847 206/390

(Continued)

FOREIGN PATENT DOCUMENTS

WO WO 2003106269 A 12/2003

OTHER PUBLICATIONS

International Search Report PCT/CA2015/000228 (dated Sep. 22, 2015).

*Primary Examiner* — Michael E Gallion
(74) *Attorney, Agent, or Firm* — Bereskin & Parr LLP/S.E.N.C.R.L., s.r.l.

(57) ABSTRACT

A bag dispensing device comprises a box and a roll of bags, the bags being connected together in the roll. Each bag defines a closed bottom end and an upper end that is closed while the bag is part of the roll but that becomes open once the bag is detached from the roll. The roll of bags is located in the container with at least one leading bag thereof extending out of the container so as to be grasped by the user and detached from the roll when a bag is needed by the user for receiving therein a sample or the like.

13 Claims, 15 Drawing Sheets

(51) Int. Cl.

| | |
|---|---|
| ***B65D 33/00*** | (2006.01) |
| ***B65D 5/18*** | (2006.01) |
| ***B65D 83/08*** | (2006.01) |

(56) References Cited

U.S. PATENT DOCUMENTS 3,229,876 A * 1/1966 Osborn, Jr. ..... B65D 83/0805 225/49
3,237,826 A * 3/1966 Ringholz ..... B65D 83/0882 206/409
3,363,828 A * 1/1968 Foglia ..... B65D 33/22 383/121
3,477,624 A * 11/1969 Harshbarger ..... B65D 83/0841 206/395
3,520,471 A * 7/1970 Faust ..... A61J 1/10 222/564
3,698,548 A * 10/1972 Stenzel ..... B65D 83/0882 225/48
3,782,650 A * 1/1974 Donnell, Jr. ..... B65H 19/2223 242/521
3,826,361 A * 7/1974 Heckrodt ..... B65H 5/28 206/409
3,958,768 A * 5/1976 Fairbanks ..... B65D 83/0847 206/225
3,979,019 A * 9/1976 Bliss ..... B65D 5/4204 221/48
3,979,050 A * 9/1976 Cilia ..... B65D 33/002 206/390
4,044,919 A * 8/1977 Olson ..... B65D 83/0852 221/63
4,453,649 A * 6/1984 Origuchi ..... B65D 83/0811 206/554
4,623,074 A * 11/1986 Dearwester ..... A47K 10/421 206/494
4,645,108 A * 2/1987 Gavin ..... B65D 5/725 206/390
4,714,643 A * 12/1987 Kuenzel ..... B65D 83/0811 206/233
4,805,800 A * 2/1989 Nocek ..... B65D 83/0894 206/554
4,850,486 A * 7/1989 Neibaur ..... B65D 83/0888 206/390
4,904,092 A * 2/1990 Campbell ..... B65D 33/001 206/390
5,046,619 A * 9/1991 Hwang ..... B65D 83/0894 206/233
5,167,377 A * 12/1992 Chalmers ..... A47F 13/085 119/161
5,170,957 A * 12/1992 Carpenter ..... B65H 35/002 206/390
5,183,157 A * 2/1993 Darden ..... B65D 33/002 206/390
5,219,424 A * 6/1993 Simhaee ..... B65D 33/002 225/106
5,228,632 A * 7/1993 Addison ..... A47K 10/3827 206/409
5,290,104 A * 3/1994 Sengewald ..... B65D 33/06 206/554
5,441,174 A * 8/1995 Sperry ..... A61M 3/0287 222/105
5,509,570 A * 4/1996 DeMatteis ..... B65D 83/08 221/303
5,564,829 A 10/1996 Lafond
5,590,784 A * 1/1997 Daniels ..... B65D 33/001 206/554
5,752,666 A * 5/1998 Simhaee ..... B65D 33/002 206/390
5,890,351 A * 4/1999 Shiotari ..... B65B 9/18 225/32
6,079,563 A 6/2000 Katchmazenski
6,135,281 A * 10/2000 Simhaee ..... B65B 43/123 206/390
6,283,405 B1 * 9/2001 Tracy ..... B65D 83/0805 206/390
6,382,551 B1 * 5/2002 Nelson ..... B65D 83/0805 206/391
6,439,502 B1 * 8/2002 Gemmell ..... A47K 10/16 242/422.4
D467,454 S 12/2002 Le et al.
6,488,222 B1 * 12/2002 West ..... B65D 33/002 242/160.4
D472,413 S 4/2003 Haas
6,575,301 B2 * 6/2003 Simhaee ..... B65D 85/62 206/499
6,635,002 B1 * 10/2003 Yeh ..... B26D 1/085 493/193
D504,812 S 5/2005 Keberlein et al.
6,945,695 B2 * 9/2005 Rabiea ..... B65H 23/06 383/35
6,976,583 B2 12/2005 Horn
7,252,194 B2 * 8/2007 Tracy ..... B65D 25/10 206/395
7,984,844 B2 * 7/2011 Jones ..... B65D 5/744 229/217
8,002,113 B1 * 8/2011 Cummings ..... B65D 85/672 206/408
8,104,657 B2 * 1/2012 Barella ..... A47K 10/421 220/495.07
D683,245 S 5/2013 Palmer et al.
D690,126 S 9/2013 Ogawa
8,534,493 B2 * 9/2013 Decker ..... A47K 10/421 221/34
8,960,494 B1 2/2015 Gluck
D735,488 S 8/2015 Page et al.
D785,362 S 5/2017 Trunsky
D787,321 S 5/2017 Pantelleria
2003/0136793 A1 * 7/2003 Chen ..... B65D 83/0805 221/63
2004/0116828 A1 * 6/2004 White, Jr. ..... A61B 10/007 600/573
2005/0194415 A1 * 9/2005 Danechi ..... B65H 16/028 225/96
2005/0274638 A1 12/2005 Smith
2006/0133701 A1 * 6/2006 Daniels ..... B31B 19/00 383/127
2006/0151660 A1 * 7/2006 Stringer ..... B65D 85/672 242/588.3
2006/0163419 A1 7/2006 Horn
2006/0169829 A1 * 8/2006 Slocum ..... B65H 18/28 242/593
2008/0187254 A1 * 8/2008 Hall ..... B65D 33/002 383/77
2008/0272016 A1 11/2008 Anderson et al.
2009/0127276 A1 5/2009 Rippl et al.
2010/0258580 A1 10/2010 Decker et al.
2011/0272442 A1 * 11/2011 Che ..... B65H 35/10 224/191
2014/0263532 A1 * 9/2014 Licata ..... B65H 35/10 225/106
2015/0196174 A1 7/2015 Goltz et al.
2015/0250364 A1 * 9/2015 Yamada ..... A47K 10/427 221/46
2016/0068327 A1 * 3/2016 Fuentes ..... B65F 1/12 220/625
2016/0107790 A1 4/2016 Maddox, Jr.

* cited by examiner

STERILE SAMPLING BAG, ROLL OF BAGS, AND BAG DISPENSER

CROSS REFERENCE TO RELATED APPLICATIONS

This Application claims priority on U.S. Provisional Application No. 61/973,143, now pending, filed on Mar. 31, 2014, which is herein incorporated by reference.

FIELD

The present subject-matter relates to the sampling bags and, more particularly, to sterile sampling bags for use in handling sample materials and the like (such as clinical samples), for instance in laboratories, in hospitals, in the food industry, etc.

BACKGROUND

Sterile sampling bags are used to collect, contain and carry a variety of sample materials that are pertinent to the agro-food, pharmaceutical, medical and environmental industries. These industries are all subject to various regulatory bodies, such as the FDA in the United States of America, Health Canada, HCAPP, etc. These regulators ensure that all products intended for consumption or interaction with the general public (either directly, such as food products, or indirectly, such as chemical fertilizers), meet scientific and measured standards that confirm their safety.

In order for a sampling bag to be viable for these industries, the following specifications should be met:

- made from virgin materials;
- does not, in any way, interfere with the integrity of the substance being tested;
- does not leach any altering chemicals, such as cadmium, mercury, lead, etc., into the substance it is carrying;
- sterile (therefore harbors no fungus, mold, aerobic or anaerobic bacteria);
- the producer provides a sterility certificate and ensure production lot number traceability for the entire shelf life of the sampling bag;
- when used for DNA detection, must be R-Nase, D-Nase and pyrogen free;
- physically viable: not porous, able to contain a specific range of PH and acidity levels;
- typical shelf life of 3 years minimum, under ambient storage conditions, before use; and
- sufficiently elastic and of low tear propensity to accommodate the pressures of a laboratory homogenizer.

With respect to the sterility requirement, sampling bags can have a tear-off strip that closes the mouth of the bag until the bag is ready to be used. Such a bag is disclosed, for instance, in U.S. Pat. No. 5,564,829 issued on Oct. 15, 1996 to Lafond, wherein a disposable sterile plastic bag B is proposed for holding samples in blenders 30 during the mixing thereof. The plastic bag B comprises a two-ply sheet flexible material 8 integrally joined at opposed side edges 12 thereof and joined at the upper and lower ends thereof respectively by upper and lower heat seals 16 and 18 with a sealed sample receiving chamber being defined between the two plastic sheets 8 inwardly of the bag's side edges 12 and upper and lower seals 16 and 18. Inwardly of the upper seal 16, a tear off line 20 is punctured transversally across the two sheets 8 and parallelly to and lower than the upper seal 16 thereby forming a detachable strip 24 outwardly of the tear off line 20. The upper heat seal 16 extends substantially parallelly between the tear off line 20 and an upper edge 26 of the bag B. When the sample is ready to be introduced in the bag B, the strip 24 is removed from the bag B by pulling it so as to cause rupture of the two sheets 8 at the tear off line 20, with the so removed strip 24 carrying thereon the upper seal 16 thereby proving an open end or mouth 22 to the bag B. The bag's chamber is thus sterile when the sample is introduced therein and the bag B and its contents can then be inserted in the blender 30. The bag's sterility does not depend on how the bag B is packaged or on the integrity of the packaging's seal as the bag B is itself sterile until the strip 24 is removed therefrom, that is typically until the bag B is ready to be used.

Such bags are packaged as individual units, the bags being stacked within a box. The user thus grasps the top bag located in the box, removes the tear off strip from the bag and then inserts the sample or the like in the bag. To remove the tear off strip from the bag, the user required the use of both his/her hands, with one hand holding the bag below the tear off strip while the other hand holds the strip and tears it off the remainder of the bag. Therefore, the user cannot hold the sample while he/she is tearing off the strip from the bag.

Therefore, there is a need for a new way of dispensing sterile bags, which is convenient to the user that must insert samples in such sterile bags.

SUMMARY

It would thus be highly desirable to provide a novel roll of sampling bags.

It would also be highly desirable to provide a novel device for dispensing sampling bags.

The embodiments described herein provide in one aspect a bag dispensing device, comprising a container and a roll of bags, the bags being connected together in the roll, each bag defining a closed bottom end and an upper end that is closed while the bag is part of the roll and that becomes open once the bag is detached from the roll, the roll of bags being located in the container and having at least one leading bag thereof extending out of the container.

Also, the embodiments described herein provide in another aspect a roll of bags, comprising a series of bags connected together to form the roll, each bag defining a closed bottom end and an upper end, the upper end being adapted to be closed while the bag is part of the roll and to become open once the bag is detached from the roll.

BRIEF DESCRIPTION OF THE DRAWINGS

For a better understanding of the embodiments described herein and to show more clearly how they may be carried into effect, reference will now be made, by way of example only, to the accompanying drawings, which show at least one exemplary embodiment, and in which.

DESCRIPTION OF VARIOUS EMBODIMENTS

Figure 1:
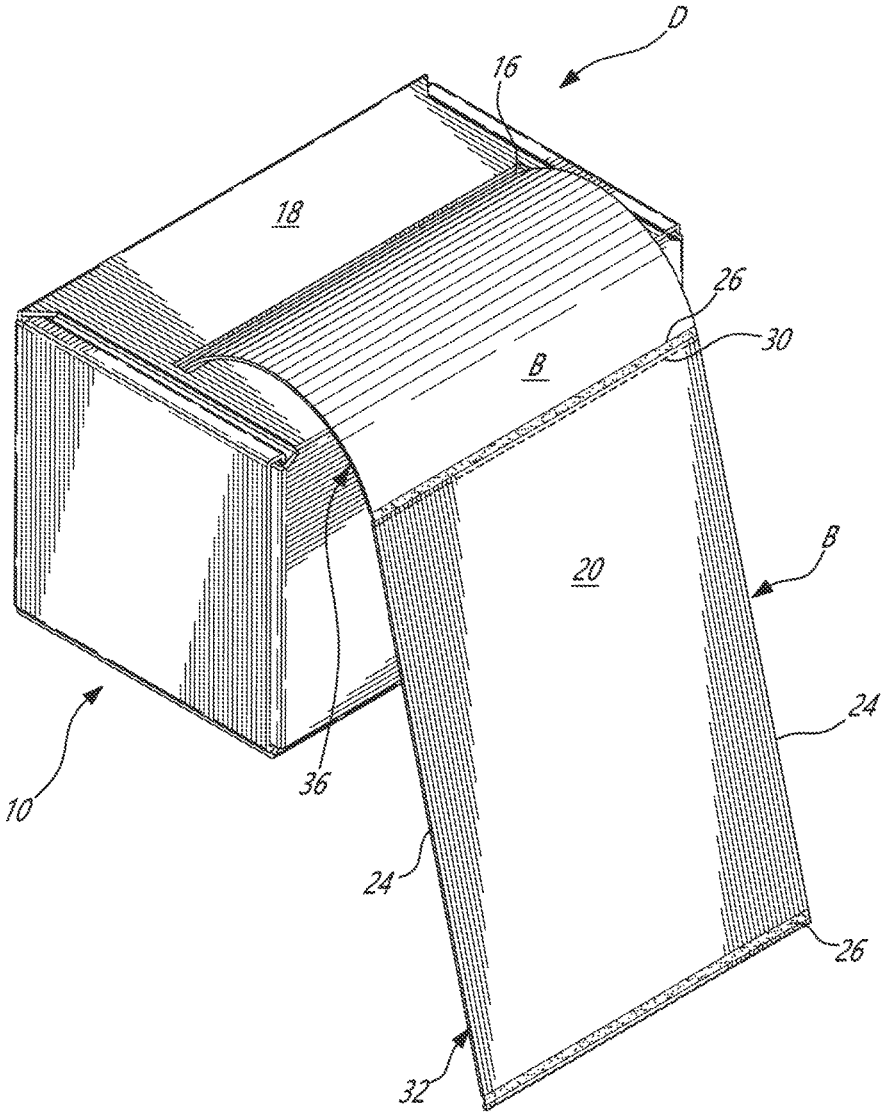
FIG. 1 is a perspective view of a bag dispensing device in accordance with an exemplary embodiment.
Figure 6:
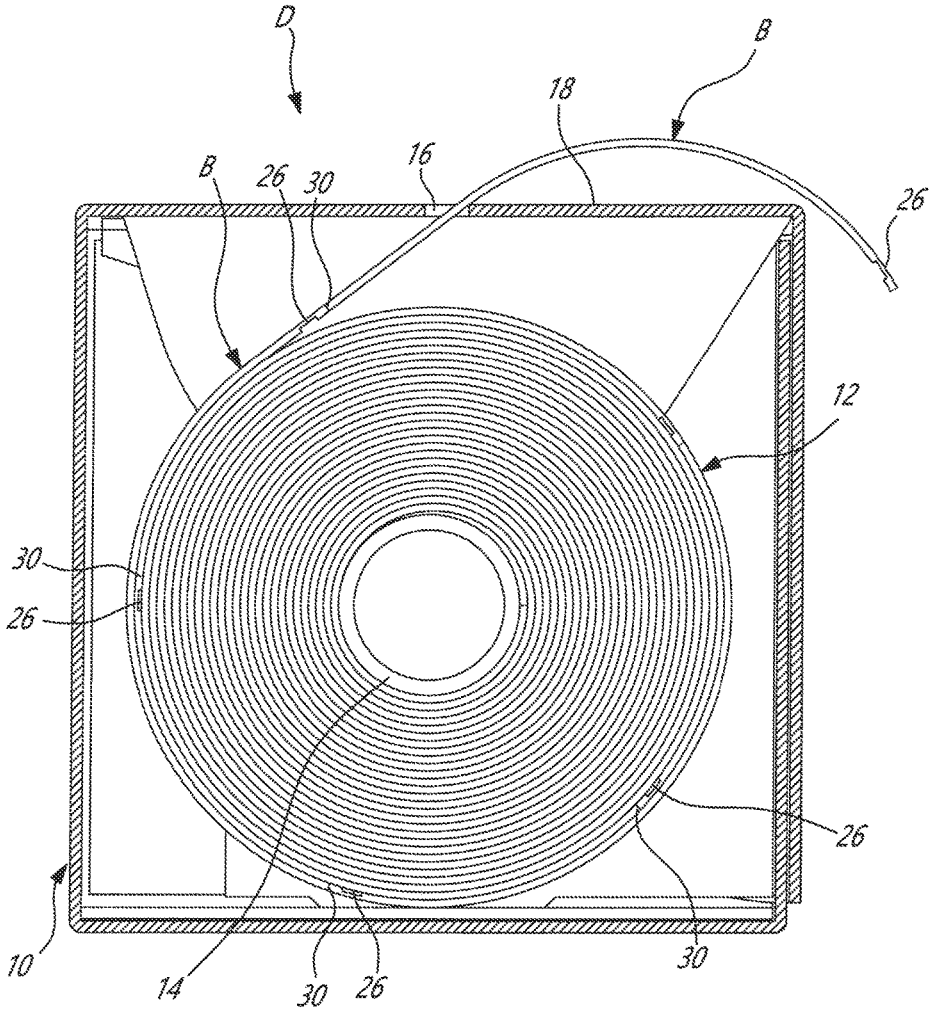
FIG. 6 is a cross-sectional view of the bag dispensing device in accordance with an exemplary embodiment.
Figure 7:
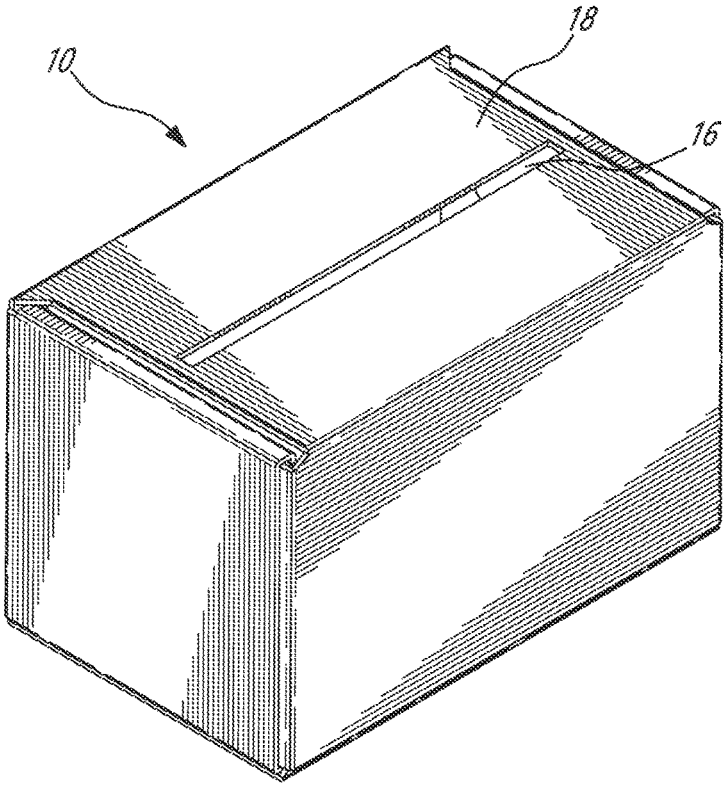
FIGS. 7 and 8 are perspective and left side elevation views of the box of the bag dispensing device in accordance with an exemplary embodiment.
Figure 8:
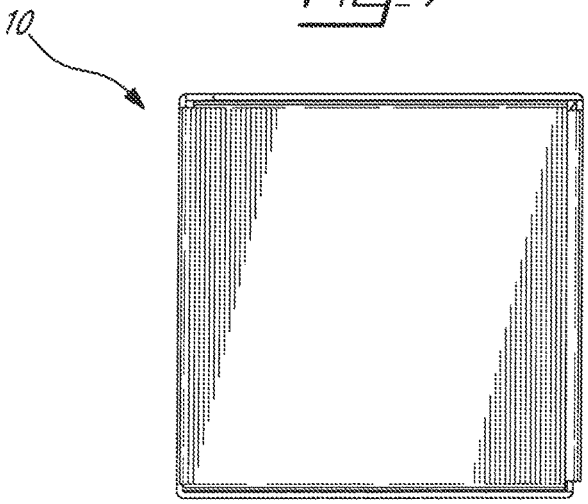

FIGS. 1 and 6 illustrate a bag dispensing device D that includes a box 10 and a roll of bags 12 contained in the box 10. The roll of bags 12 includes a large number of successive bags B, wound around a cylindrical core 14. The box defines an elongated slot 16 on its upper side 18, with the leading bags of the roll 12 protruding from the box 10 through the slot 16.

Figure 2:
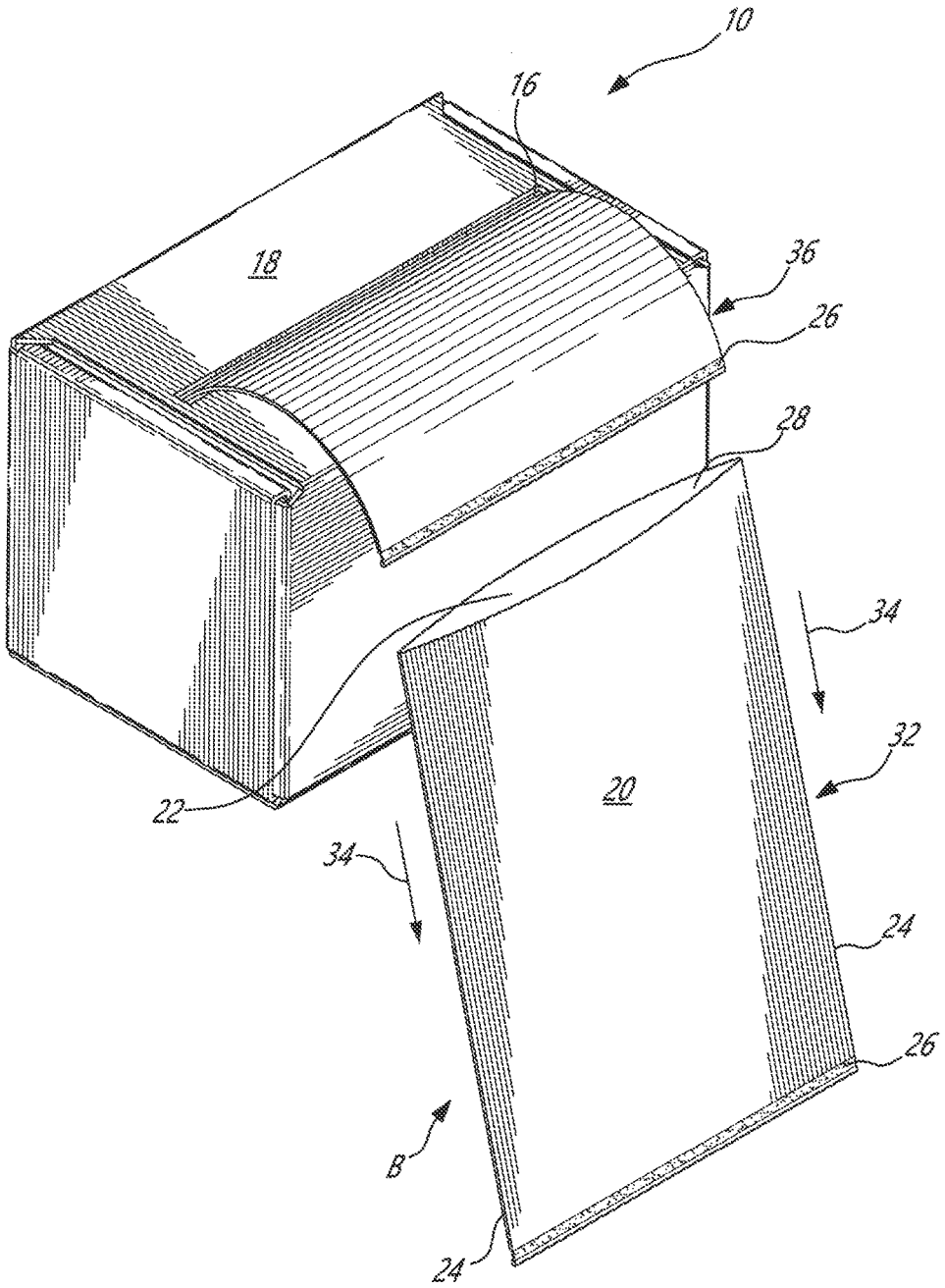
FIG. 2 is a perspective view of the bag dispensing device in accordance with an exemplary embodiment, showing a leading bag having been detached from a roll of bags located in a box of the device.

The bag B, which is typically made from plastic, for instance from heavy-gauge transparent polyethylene, includes front and rear panels 20 and 22, respectively, which are integrally joined at the side edges 24 thereof. The bottom of the bag B is closed by a heat seal 26, and the top of the bag B is closed when connected to the roll 12, but opens up when detached from the roll 12, as seen in FIG. 2, such as to define an open mouth 28. When the bags B are connected together on the roll 12, successive bags are connected by a tear off line 30, which is punctured transversely across the bag B at its upper end. When the leading bag (see bag 32 in FIG. 1) is pulled on along arrows 34 in FIG. 2, it detaches at the tear off line 30 from the next bag 36 on the roll 12, as seen in FIG. 2, thereby providing to the user a sterile bag into which a sample, or the like, can be inserted.

The user can with a single hand detach the leading bag 32 from the roll 12, thereby allowing the user to conveniently retrieve a sterile bag B, 32 from the bag dispensing device B while holding in his/her other hand the sample to be put in the bag B. This simplifies the process of obtaining a sterile bag and putting a sample therein, while maintaining the bag B sterile until it is required by the user. The weight of the roll 12 and/or the upper side 18 of the box 10 provide the required resistance that allows the leading bag 32 to be detached from the roll 12 without having to hold on to the box 10, thereby again allowing the user to retrieve the bag B, 32 with one hand while holding the sample with the other hand. If needed, the box 10 can be anchored to offer more resistance when the leading bag 32 is being detached from the roll 12.

Figure 3A:
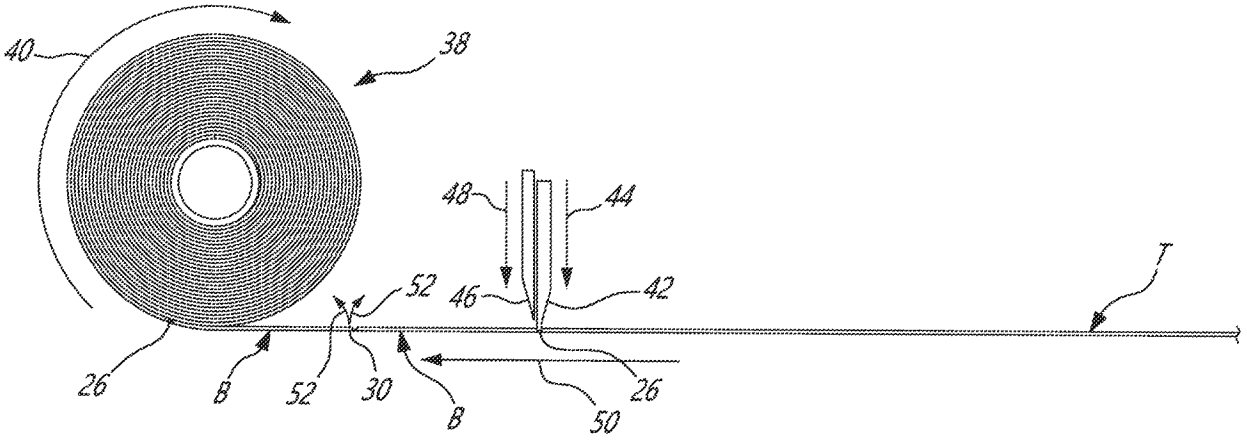
FIGS. 3A and 3B are side views showing, in accordance with an exemplary embodiment, a tubular plastic strip being transformed into a roll of bags.
Figure 3B:
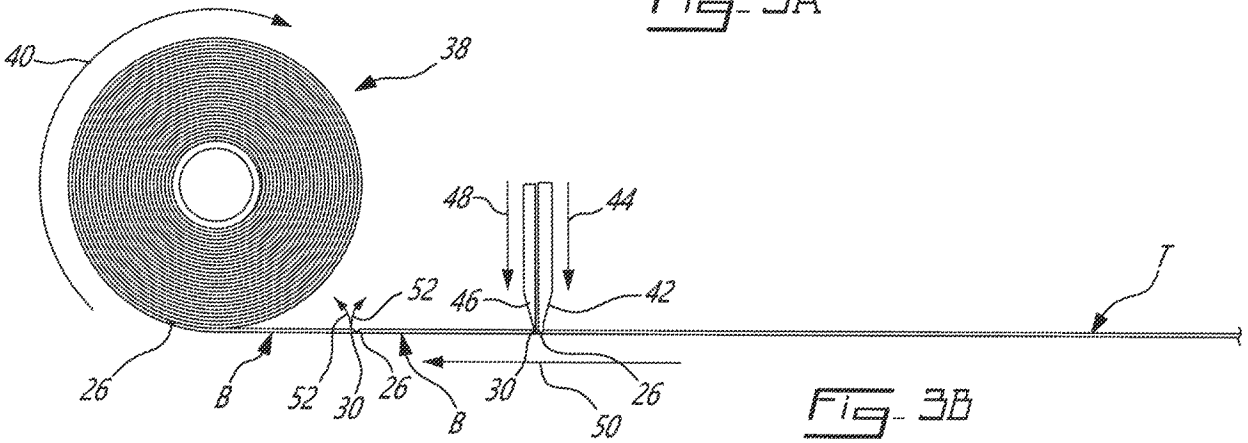

FIGS. 3A and 3B show basically how the bottom seals 26 and the tear off lines 30 are defined on the tube of plastic to produce individual bags B that are successively attached to each other and wound on the roll 12. More particularly, a long tube or sleeve of plastic T is provided. Alternatively, two elongated panels of plastic could be welded at their longitudinal edges to produce the required rube. By using a tube T, the bags B that are produced have no side seams, thereby reducing the costs of manufacture of the bags B and increasing the efficiency of the protection afforded by the bags B.

The tube T is wound around a production roll 38 as per arrow 40, and before the tube T reaches the production roll 38, a heating device 42 is lowered onto the tube T as per arrow 44 (see FIG. 3A), and a perforating device 46 is lowered also on the tube T as per arrow 48 (see FIG. 3A). The heating device 42 produces the heat seal 26 thereby closing the bottom end of each bag B, whereas the perforating device 46 produces the tear off line 30, which is located just downstream of the heat seal 26 relative to arrow 50. It is noted that both the actions effected by the heating device 42 and the perforating device in FIGS. 3A and 3B could be performed simultaneously.

Figure 4:
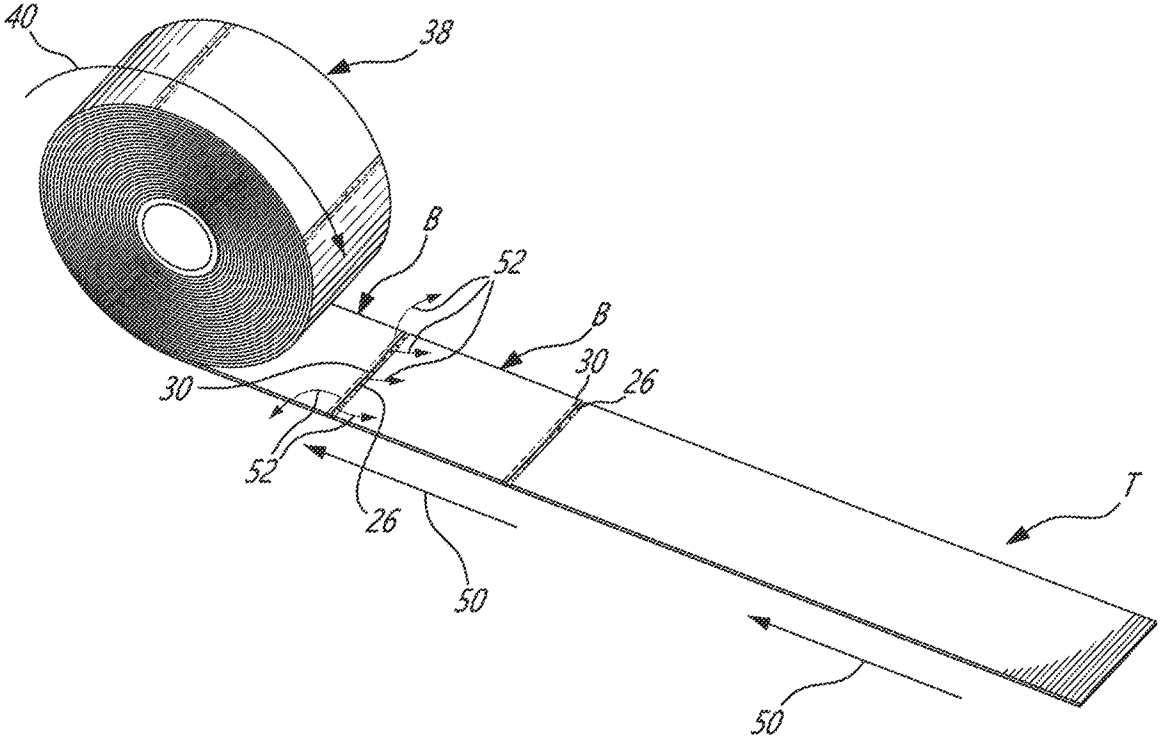
FIG. 4 is a perspective view showing the roll of bags of FIGS. 3A and 3B, in accordance with an exemplary embodiment.

Importantly, as the tear off line 30 of a bag B trails its sealed bottom end 26, air in the tube T is expelled through the tear off line 30 (see arrows 52 in FIGS. 3A, 3B and 4) when the bag B is being wound around the production roll 38. Indeed, the pressure exerted on each bag B as it is being wound around the production roll 38 forces the air out of the bag B. If the bags were being wound with their leading ends first, such air would remain in the bag B as being imprison therein by the side edges 24 and the sealed bottom end 26 thereof (the air pressure in the bag B could even damage the bag B).

Figure 5:
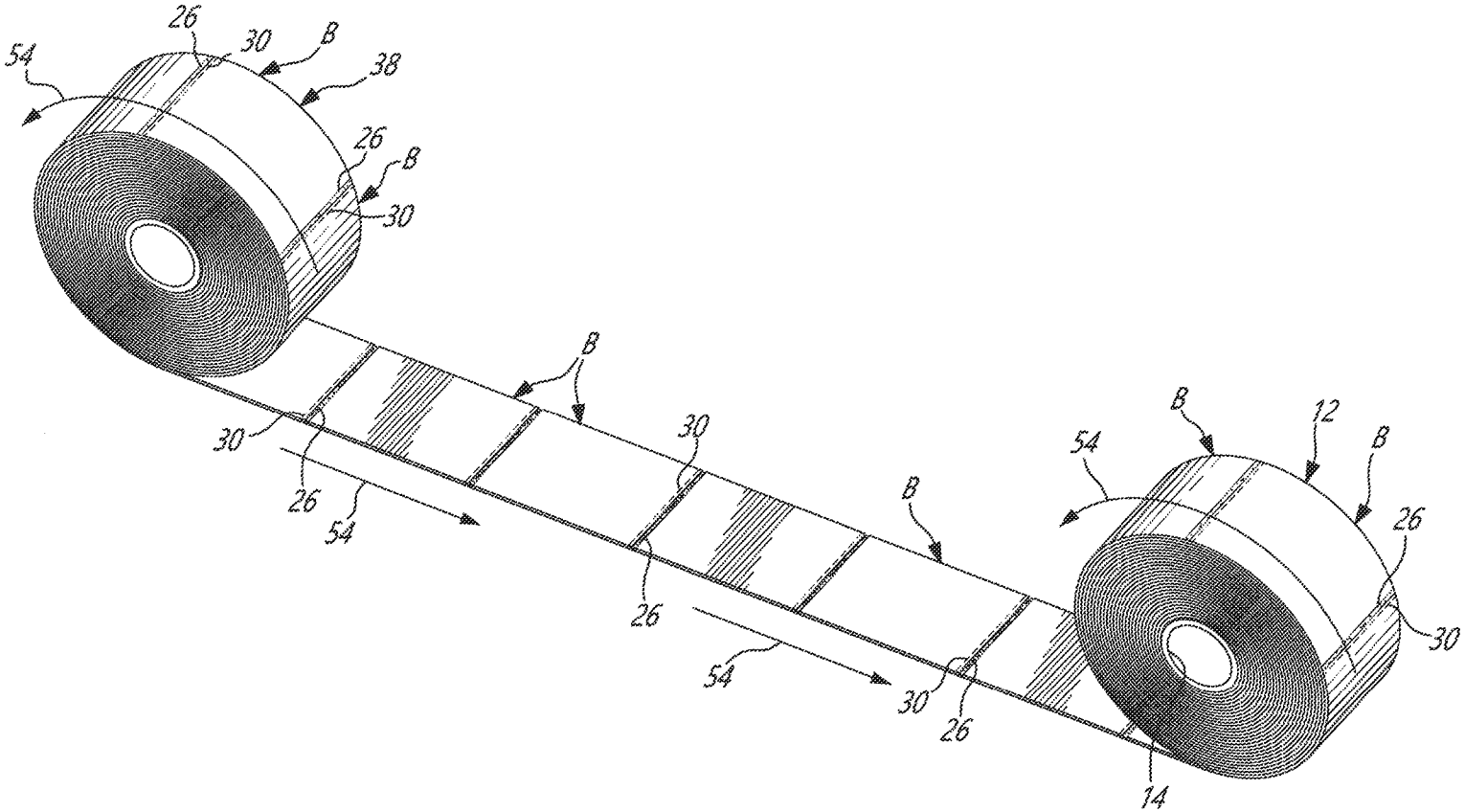
FIG. 5 is a perspective view showing the roll of bags of FIGS. 3A, 3B and 4 being reversibly wound onto a new roll of bags, in accordance with an exemplary embodiment.

Now referring to FIG. 5, the attached bags B on the production roll 38 are transferred on the roll of bags 12, by winding the bags B onto the core 14 of the roll 12 while the bags B unwind from the production roll 38, as per arrows. Once the bags B are rolled onto the roll 12, the roll of bags 12 can be positioned in the box 10 and the leading bag 32 and next bag 36 can be extended through the slot 16, as seen in FIGS. 1 and 2. The bags B are dispensed from the roll 12 with their sealed bottom ends 26 leading and their upper ends (closed at the tear off line 30) trailing. This configuration is contrary to bags, for instance provided for vegetables and fruits in supermarkets, where the leading ends of the bags are their upper ends, such that the leading bag is open while it is still on the roll, such that it may remain open well before it is used, whereby this would be unsuitable for sterile applications, as herein. In the case of the bags 12, the leading bag on the roll 12 remains closed until it is detached from the roll 12, whereat only then does the upper end of the bag B becomes open at mouth 28. This provides the required sterility in the each bag 12 and avoids compromising this sterility before the bag 12 is used, i.e. before it is detached by the user from the roll 12, as illustrated in FIG. 2. Indeed, with this construction, the bag B remains substantially and sufficiently sterile until it is used, that is until it is detached at the tear off line 30 from the roll of bags 12.

Figure 9:
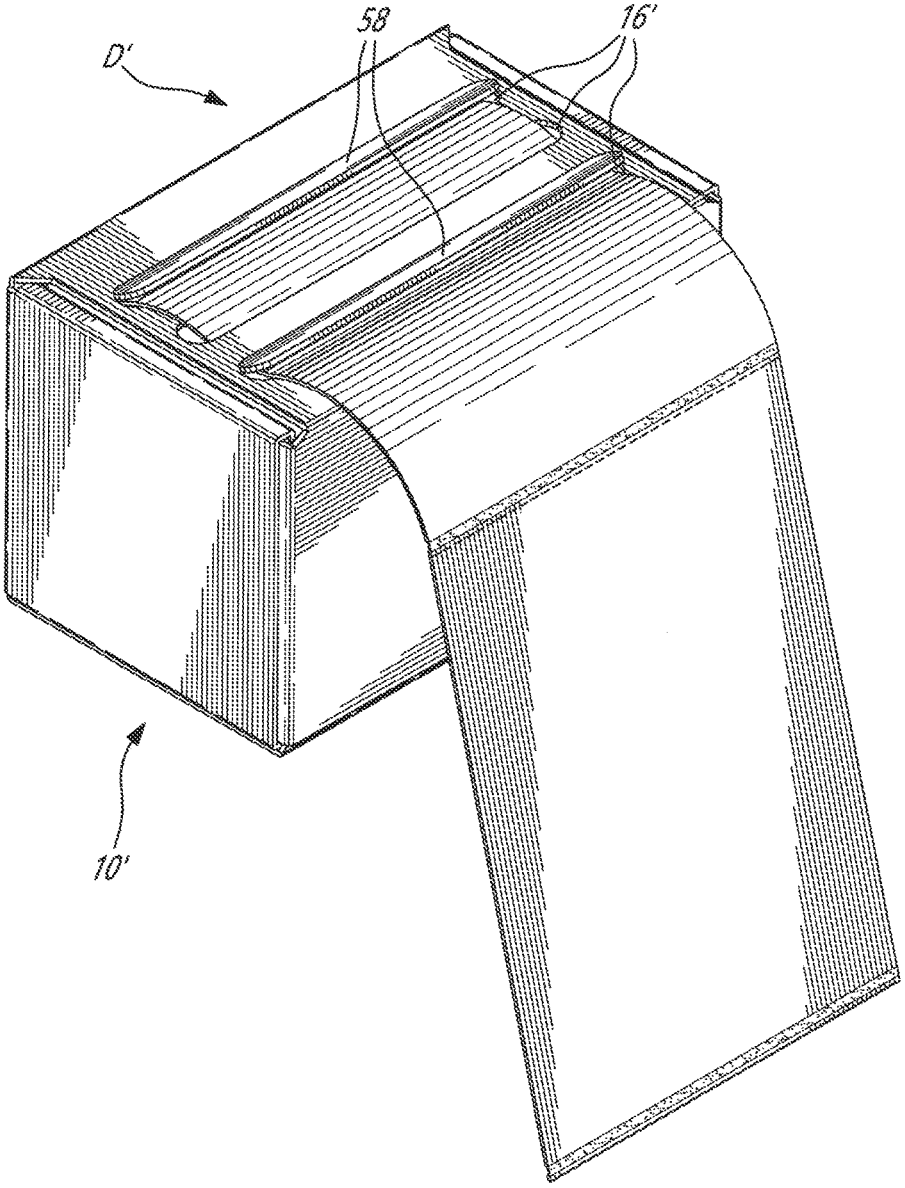
FIG. 9 is a perspective view of a bag dispensing device in accordance with a second exemplary embodiment.
Figure 10:
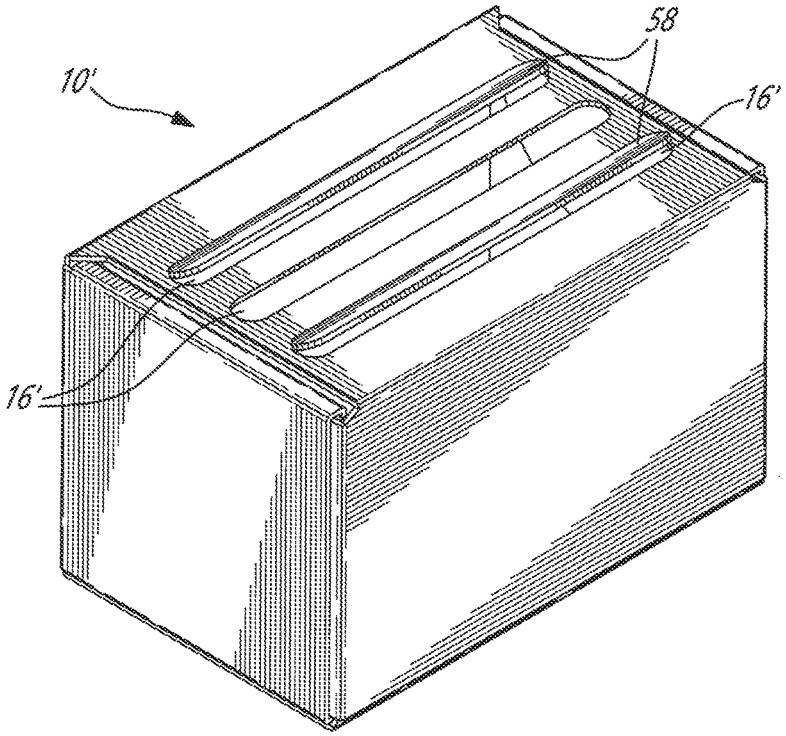
FIGS. 10 and 11 are perspective and left side elevation views of a box of the bag dispensing device of FIG. 9, in accordance with an exemplary embodiment.
Figure 11:
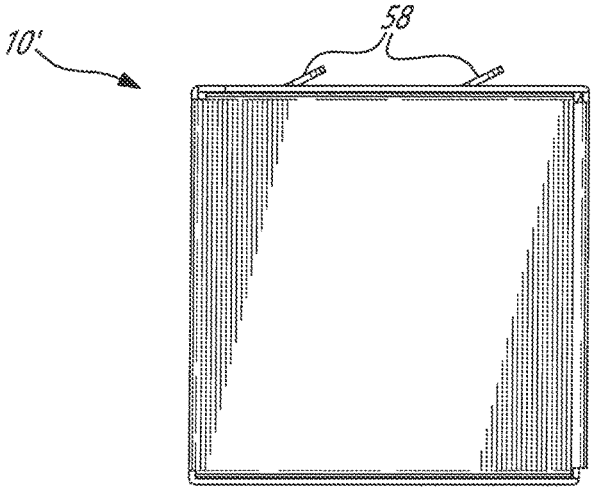

FIGS. 9 to 11 show another bag dispensing device D', which is similar to the bag dispensing device D of FIGS. 1 to 8, but wherein there are provided three elongated slots 16', with the strip of bags B being threaded through all three slots 16', as seen in FIG. 9. Raps 58 are provided on the two outside slots 16' for at least one of guiding and exerting pressure on the strip of bags B.

Figure 12:
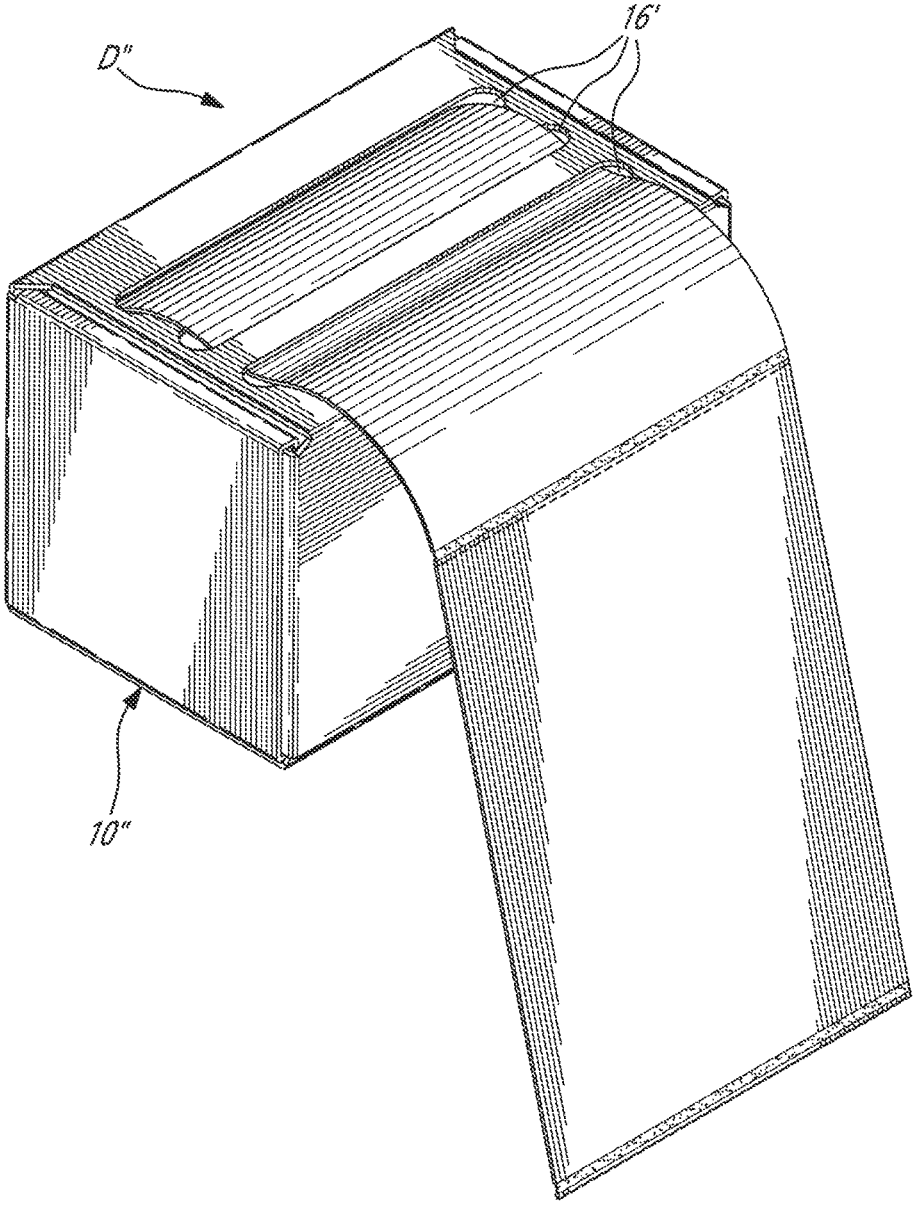
FIG. 12 is a perspective view of a bag dispensing device in accordance with a third exemplary embodiment.
Figure 13:
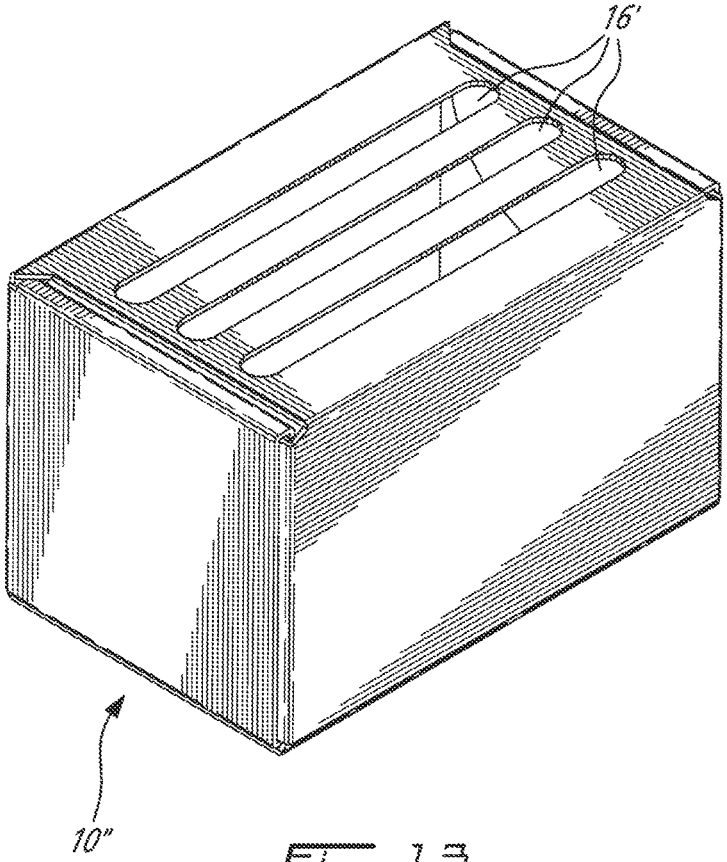
FIGS. 13 and 14 are perspective and left side elevation views of a box of the bag dispensing device of FIG. 12, in accordance with an exemplary embodiment.
Figure 14:
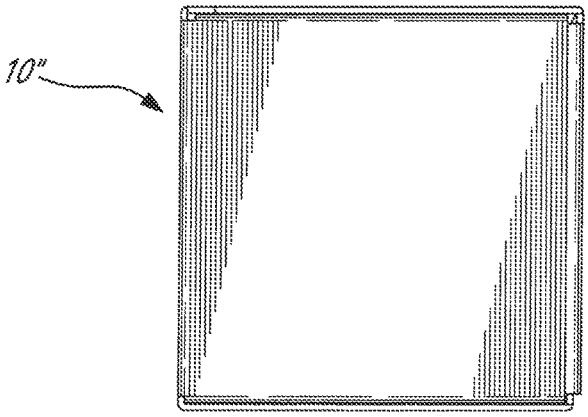

FIGS. 12 to 14 show a further bag dispensing device D", which is similar to the bag dispensing device D' of FIGS. 9 to 11, but wherein there are no flaps 58 as in the bag dispensing device D'.

Figure 15A:
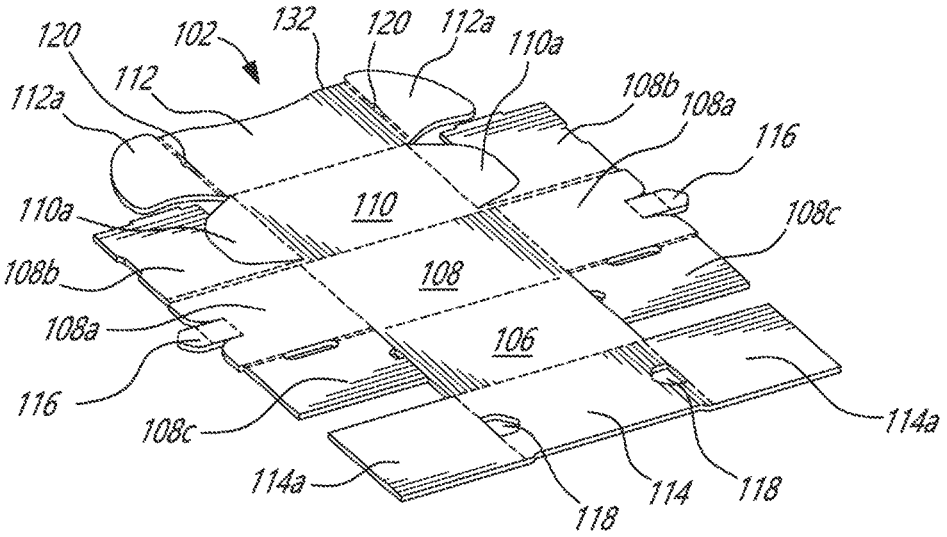
FIGS. 15A to 15E are perspective views of a bag dispensing device in accordance with an exemplary embodiment, showing how the device is sequentially put together, but shown without the roll of bags.
Figure 15B:
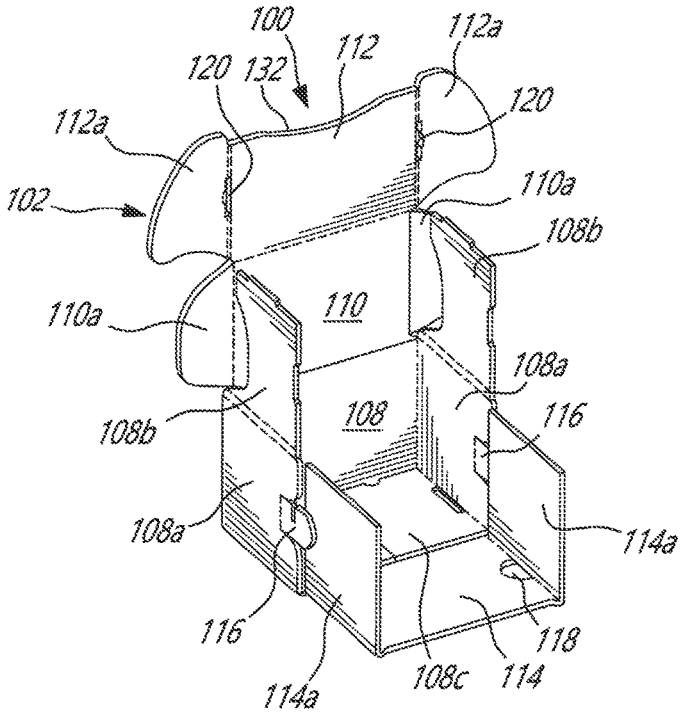
Figure 15C:
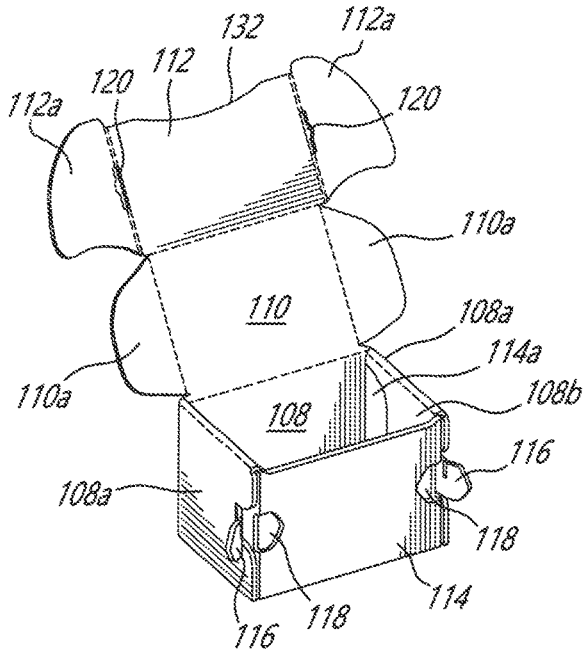
Figure 15D:
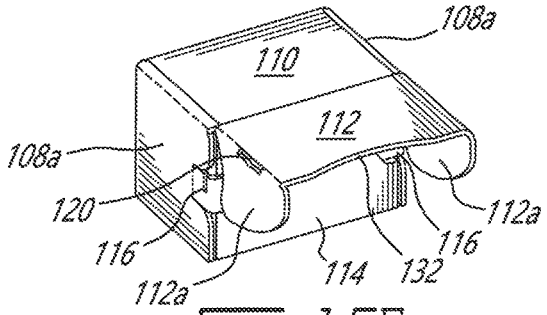
Figure 15E:
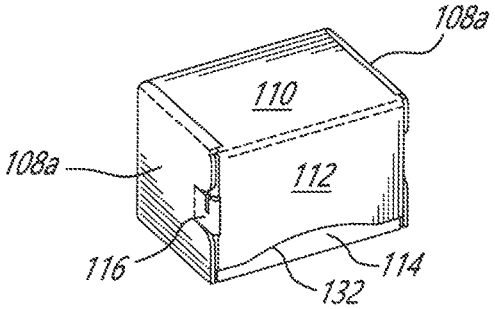
Figure 16A:
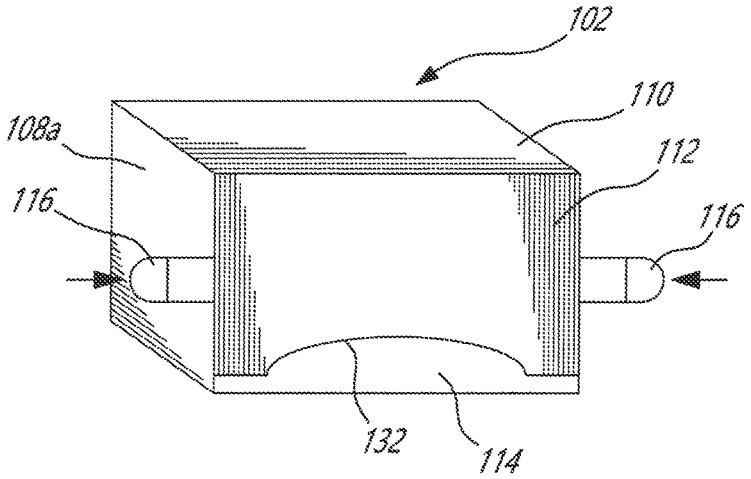
FIGS. 16A to 16D are perspective views showing how the bag dispensing device of FIGS. 15A to 15E is sequentially manipulated in order to put a bag of rolls therein, in accordance with an exemplary embodiment.
Figure 16B:
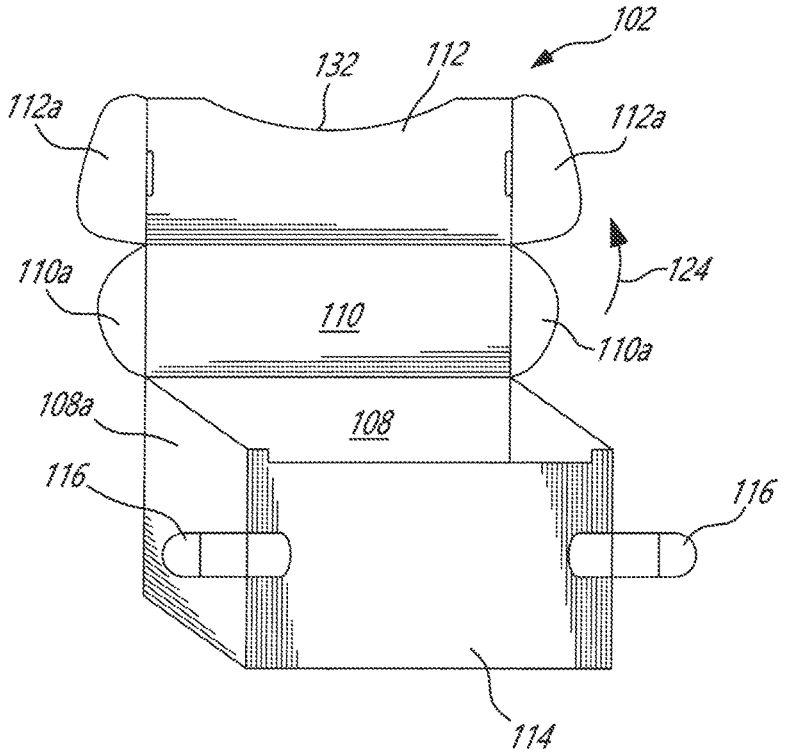
Figure 16C:
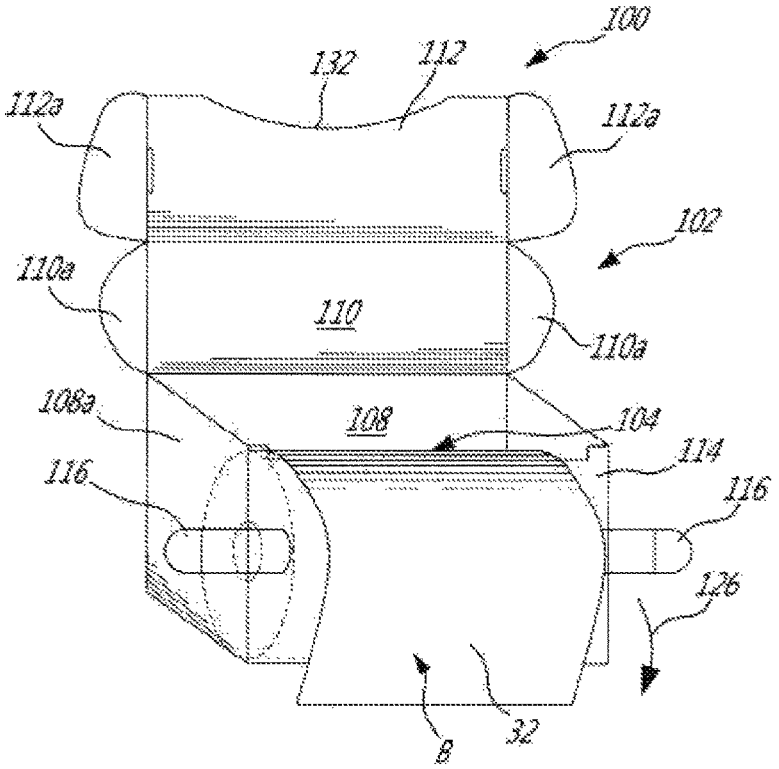
Figure 16D:
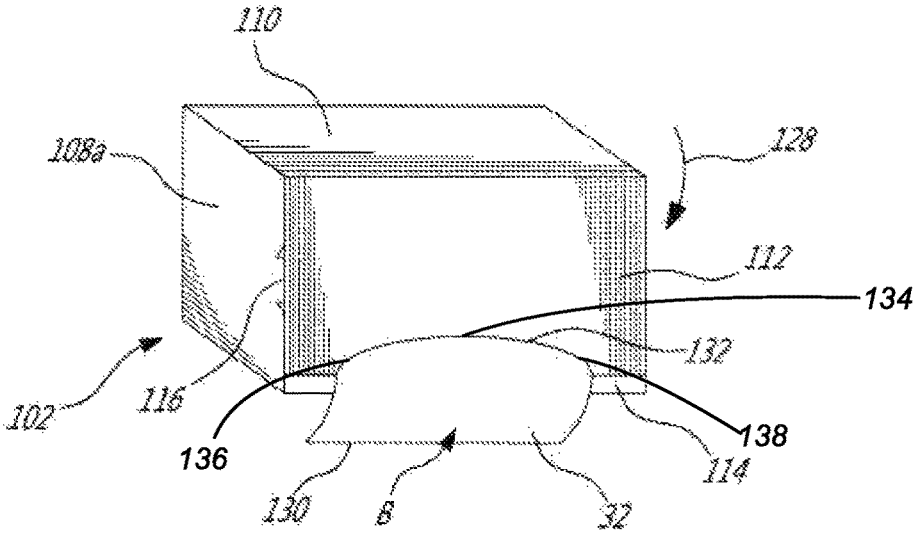

FIGS. 15A to 15E illustrate a further bag dispensing device 100, which includes a box 102 and a roll 104 of bags B, the latter being shown in FIG. 16C, The bag dispensing device 100 differs from the bag dispensing devices D, D' and D" mainly in that the bags B are not dispensed therefrom through the top of the boxes 10, 10' and 10", but rather through a lower front area thereof, as best seen in FIG. 16D and as detailed hereinafter.

FIGS. 15A to 15E sequentially show how the bag dispensing device 100 is assembled, wherein FIG. 15A illustrates the box 102 as a blank in a knock-down position. The box 102 includes a bottom wall 106, a rear wall 108 (having dependent opposed side panels 108*a*, side panels 108*b*, and bottom panels 108*c*), a top wall 110 (having dependent opposed side panels 110*a*), a front flap 112 (having dependent opposed side panels 112*a*), and a front wall 114 (having dependent opposed side panels 114*a*. A pair of foldable locking tabs 116 extend outwardly from the side panels 108*a*. A pair of notches 118 are defined in the front wall 114, just inwardly of the side panels 114*a*. A pair of slits 120 are defined in the front flap 112, at the junction of the side panels 112*a*.

In FIG. 15B, the bottom panels 108*c* overlie the bottom wall 106. In FIG. 15C, the side panels 114*a* are sandwiched between outer side panels 108*a* and inner side panels 108*b*. In FIG. 15D, the side panels 110*a* are located inwardly of the inner side panels 108*b*, within the closed box. In FIG. 15E, the side panels 112*a* are inserted inwardly of the outer side panels 108*a*, and the front flap 112 is located in front of the front wall 114, with the locking tabs 116 having being folded inwardly at a 90° angle and then having been inserted in the slits 120 and lodging in the notches 118.

FIGS. 16A to 16DE sequentially show how the roll of bags 104 is loaded in the bag dispensing device 100. In FIG. 16A, the locking tabs 116 are disengaged from the slits 120, thereby allowing the front flap 112 and the top wall 110 to be raised, along arrow 124 in FIG. 16B. The roll of bags 104 can then be deposited in the open box 102, as shown in FIG. 16C. As also illustrated in FIG. 16C, the leading bag 32 of the roll 104 is positioned over the upper edge of the front wall 114 so as to drop in front thereof, as per arrow 126.

The front flap 112 and the top wall 110 are then lowered along arrow 128 in FIG. 16D to close the box 102, with the leading bag 32 extending between the front wall 114 and the front flap 112. The locking tabs 116 are then engaged into the slits 120, thereby securing the front flap 112 and the top wall 110 in closed positon. More specifically, the leading bag 32 is positioned in front of the front wall 114 and behind the front flap 112. A leading end 130 of the leading bag 32 is visible as extending below a lower edge 132 of the front flap 112. The leading edge 132 is concave-like so that the leading end 130 of the leading bag 32 is easier to grasp. In this configuration, the lower edge 132 of the panel is curved such that a central portion 134 of the lower edge is further spaced apart from the plane of the bottom wall than side portions 136 and 138 of the lower edge.

The leading bag 32 thus extends within a thin channel defined between the front wall 114 and the front flap 112. When a user wishes to separate the leading bag 32 from the rest of the roll 104, he/she pulls on the leading end 130 of the leading bag 32, with the front flap 112 being sufficiently secured to the rest of the box 102 so as to offer the required resistance to the unwinding of the roll 104 in the box 102 and to the force being applied on the leading bag 32 such as to allow the leading bag 32 to be torn from the roll 104.

The present invention is thus very useful to provided simple, economical and sterile sampling bags having a stand-alone sterility which was not offered by conventional bags used in blenders. Indeed, the sterility of the present bag B is not the result as in the prior art of being contained in a sealed pouch along with other bags but is the consequence of the present bag's stand-alone sterility as the bag B in its state shown in PG. 2 is sterile although not enclosed in a sealed packaging pouch.

With the present arrangement of successive plastic bags B, plastic material is also saved with respect to the plastic bag disclosed in aforementioned U.S. Pat. No. 5,564,829, as herein there no detachable strip to be discarded, such as the tear-off strip 24 of U.S. Pat. No. 5,564,829.

While the above description provides examples of the embodiments, it will be appreciated that some features and/or functions of the described embodiments are susceptible to modification without departing from the spirit and principles of operation of the described embodiments. Accordingly, what has been described above has been intended to be illustrative of the embodiments and non-limiting, and it will be understood by persons skilled in the art that other variants and modifications may be made without departing from the scope of the embodiments as defined in the claims appended hereto.

The invention claimed is:

1. A bag dispensing device, comprising:

a container and a roll of sterile bags, the bags being connected together in the roll, each bag defining a closed bottom end and a top end that is closed while the bag is part of the roll and that becomes open once the bag is detached from the roll, the roll of bags being adapted to be located in the container and having at least one leading bag thereof extending out of the container, wherein an opening is provided at a lower front side of the container through which the leading bag is adapted to extend, thereby allowing the leading bag to be removed while a next bag is brought through and beyond the opening, the opening being defined at least by a front wall of the container and a front flap extending outwardly and partially covering the front wall, wherein a lower edge of the front flap having a single concave cut-out.

2. The roll of bags of claim 1, wherein the bottom end and the top end extend substantially parallel to a rotation axis of the roll.

3. The roll of bags of claim 1, wherein the roll includes a cylindrical core with the bottom end and the top end of each bag extending substantially transversely of the cylindrical core.

4. The roll of bags of claim 1, wherein the bottom end of each bag is closed by way of a heat seal.

5. The roll of bags of claim 1, wherein a tear-off line is defined at a junction of the top end of one bag and the bottom end of an adjacent bag.

6. The roll of bags of claim 1, wherein the bags are arranged on the roll such that, as the bags are adapted to be unwound from the roll, a leading end of each bag includes the closed bottom end thereof, whereas a trailing end of each bag includes the top end thereof.

7. The roll of bags of claim 5, wherein the tear-off line is provided at a junction of the trailing end of a leading bag and the leading end of a subsequent bag, the tear-off line adjacently leading the closed end of the subsequent bag.

8. The roll of bags of claim 5, wherein the top end of each bag is closed while the bag is part of the roll, whereas once the bag is detached from the roll at the tear-off line, the top end of the detached bag defines an open mouth at the tear-off line thereby allowing the detached bag to received substances therein.

9. The bag dispensing device of claim 1, wherein the front flap is pivotally mounted to a front edge of a top wall of the container and adapted to extend downwardly therefrom along the front wall, the leading bag being adapted to extend downwardly between the front flap and the front wall and to exit the opening at the lower edge of the front flap.

10. The bag dispensing device of claim 9, wherein the lower edge of the front flap extends above a plane of a bottom wall of the container.

11. The bag dispensing device of claim 10, wherein the lower edge of the front flap has a central portion thereof that is further spaced apart from the plane than side portions thereof.

12. The bag dispensing device of claim 1, wherein at least one locking element is provided for attaching the front flap to a remainder of the container.

13. The bag dispensing device of claim 12, wherein there are provided a pair of locking elements of the at least one locking element disposed at opposite side walls of the container and adapted to engage lateral sides of the front flap.

* * * * *